US006356241B1

(12) United States Patent
Jaeger et al.

(10) Patent No.: US 6,356,241 B1
(45) Date of Patent: Mar. 12, 2002

(54) COAXIAL CAVITY ANTENNA

(75) Inventors: Rodney H. Jaeger, Mesquite; William E. Rudd, Dallas; Randel E. Ackerman; Timothy R. Holzheimer, both of Rockwall, all of TX (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/418,764

(22) Filed: Oct. 15, 1999

Related U.S. Application Data

(60) Provisional application No. 60/104,968, filed on Oct. 20, 1998.

(51) Int. Cl.[7] ..... H01Q 1/42

(52) U.S. Cl. ..... 343/789; 343/776; 343/786

(58) Field of Search ..... 343/776, 786, 343/789, 790, 791, 795, 797, 816; H01Q 1/42

(56) References Cited

U.S. PATENT DOCUMENTS

| | | | | | |
|---|---|---|---|---|---|
| 3,508,277 | A | | 4/1970 | Ware et al. | 343/776 |
| 3,871,000 | A | * | 3/1975 | Tymann | 343/771 |
| 4,042,935 | A | * | 8/1977 | Ajioka et al. | 343/795 |
| 4,443,804 | A | | 4/1984 | Smith | 343/786 |
| 5,041,840 | A | | 8/1991 | Cipolla et al. | 343/725 |
| 5,107,274 | A | | 4/1992 | Mitchell et al. | 343/756 |
| 5,220,337 | A | * | 6/1993 | Ajioka | 343/770 |
| 5,276,457 | A | * | 1/1994 | Agarwal et al. | 343/789 |
| 5,548,299 | A | * | 8/1996 | Tsuda et al. | 343/789 |
| 5,552,797 | A | * | 9/1996 | Cook | 343/786 |
| 5,793,335 | A | * | 8/1998 | Anderson et al. | 343/786 |
| 5,818,396 | A | | 10/1998 | Anderson et al. | 343/786 |
| 5,907,309 | A | * | 5/1999 | Anderson et al. | 343/786 |

FOREIGN PATENT DOCUMENTS

| | | | |
|---|---|---|---|
| EP | 0 556 941 A1 | 8/1993 | H01Q/1/24 |

* cited by examiner

*Primary Examiner*—Tan Ho
*Assistant Examiner*—Trinh Vo Dinh
(74) *Attorney, Agent, or Firm*—Baker Botts L.L.P.

(57) ABSTRACT

A coaxial cavity antenna including a cylindrical inner conductor sized for propagation of electromagnetic signals in a preselected frequency range. The coaxial antenna also includes a cylindrical outer conductor positioned coaxial with the inner conductor, and having a diameter larger than the inner conductor. The outer conductor has an aperture ring disposed at an end of the outer conductor. The outer conductor is positioned with respect to the inner conductor to form a cavity between the inner conductor and the outer conductor. The cavity is sized for propagating electromagnetic signals in the preselected frequency range. The coaxial cavity antenna also includes a plurality of aperture teeth radially oriented and disposed around the aperture ring, and an iris ring positioned inside the cavity at a predetermined distance from the aperture ring. In addition, the coaxial cavity antenna includes a plurality of septums coupled to the inner conductor and the iris ring, and a plurality of cable supports coupled to the outer conductor.

31 Claims, 7 Drawing Sheets

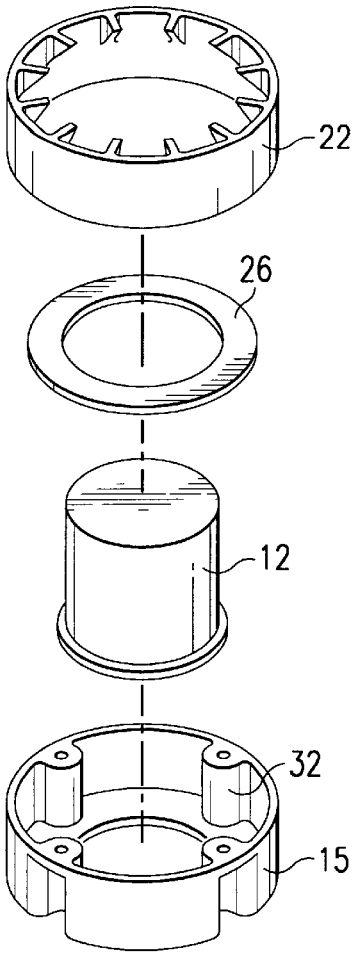
FIG. 7
FIG. 8
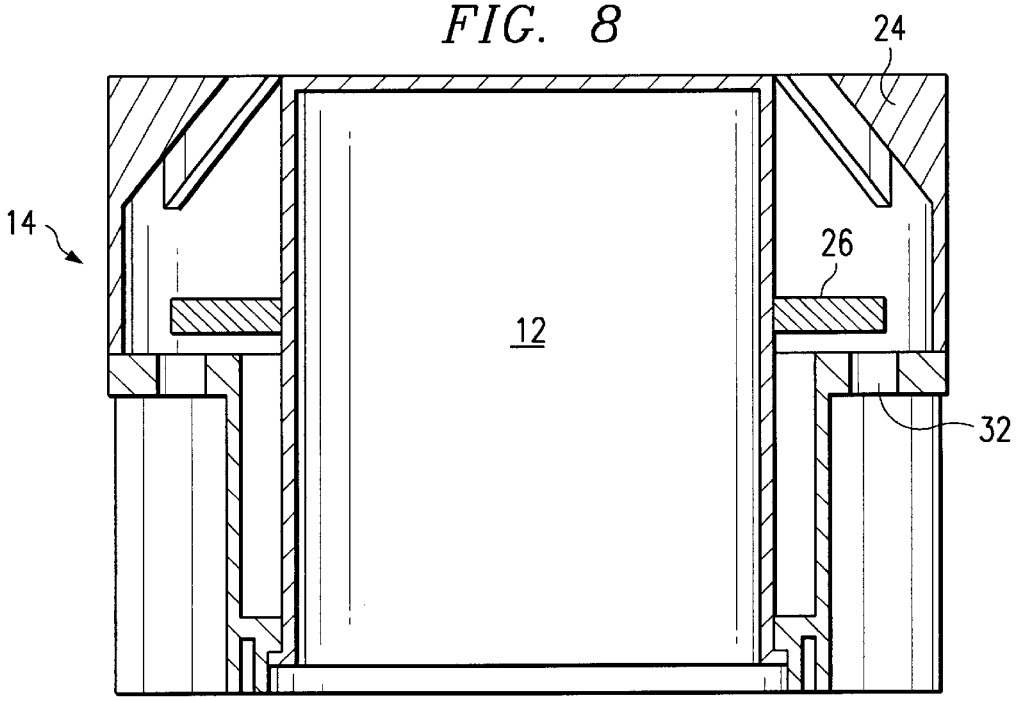

COAXIAL CAVITY ANTENNA

RELATED APPLICATION

This application claims the benefit of U.S. provisional application Ser. No. 60/104,968, filed Oct. 20, 1998, entitled Coaxial Cavity Antenna

TECHNICAL FIELD OF THE INVENTION

This invention relates generally to antennas and more particularly to a coaxial cavity antenna.

BACKGROUND OF THE INVENTION

Coaxial antennas have been produced for some time. However, they have all suffered from electrical plane ("E-plane") and magnetic plane ("H-plane") pattern differences. Specifically, in a typical coaxial radiator, differences in the aperture distributions of the E & H planes cause the E-plane pattern to narrow as frequency increases. This narrowing is not desirable in a dual polarized antenna, that is, the net result is wide azimuth/narrow elevation for one sense of polarization and narrow azimuth/wide elevation for the other sense of polarization. For the case of the dual circularly polarized coaxial antenna, this is undesirable as it results in unacceptable axial ratio performance. Similarly, for a dual linearly polarized coaxial antenna, E & H plane pattern differences result in unacceptable differences in field of view coverage. The differences in the E & H plane patterns also limits the useful operating bandwidth.

Previous coaxial antenna technology has approximately a 30% usable bandwidth. This is achieved by employing various combinations of inner to outer diameter conductors, radial aperture stubs, and miscellaneous other feeding schemes and arrangements.

SUMMARY OF THE INVENTION

Accordingly, a need has arisen for a polarization diverse, high gain, wide bandwidth antenna with low dispersion properties. The present invention provides a coaxial cavity antenna that addresses shortcomings of prior systems and methods.

According to one embodiment of the invention, a coaxial cavity antenna includes a generally cylindrical inner conductor sized for propagation of electromagnetic signals in a predetermined frequency range. The coaxial antenna also includes a generally cylindrical outer conductor formed generally coaxial with the inner conductor, and having a larger diameter than the inner conductor. The outer conductor includes an aperture ring disposed at an end of the outer conductor. The outer conductor is positioned with respect to the inner conductor to form a cavity between the inner conductor and the outer conductor. The cavity is sized for propagating electromagnetic signals in a predetermined frequency range. The coaxial cavity antenna also includes a plurality of aperture teeth disposed around the aperture ring, and an iris ring disposed inside the cavity at a predetermined distance from the aperture ring. Furthermore the coaxial cavity antenna includes a plurality of septums coupled to the inner conductor and the iris ring, and a plurality of cable supports coupled to the outer conductor.

The invention provides numerous technical advantages. For example, the problem of a narrow E-plane has been minimized in an antenna in accordance with the present invention. The antennas of the present invention exhibit substantially symmetric E-plane and H-plane performance over reasonably wide angles, such as ±60 degrees, and over reasonably wide frequency bandwidths, such as an octave per sub-band. Another advantage of the present invention is that the antennas are scalable, and through the appropriate choice of inner to outer cavity sizes and depths can be nested in a concentric configuration to provide multi-octave performance.

Other advantages offered by the present invention are dual polarization, high gain, relatively small size and weight, wide bandwidth, and excellent amplitude and phase response in terms of pattern control, phase/amplitude tracking, and cross polarization. All of these are over a field of view greater than or equal to ±60 degrees. Antennas in accordance with the present invention have been constructed having bandwidths of 0.5 to 2.0 GHz, 2.0 to 8.0 GHz, and even the whole 2.0 to 18.0 GHz range.

Antennas in accordance with the present invention have applications as elements in interferometers, polarimetry antennas, and as various types of reflector feeds. Antennas incorporating the present invention have excellent dispersion properties making them excellent time domain antennas for use in very wideband systems. Antennas in accordance with the present invention can be arrayed in vertical stacks in order to provide increased directivity (gain) by narrowing the elevation beamwidth. In addition, antennas in accordance with the present invention have few mechanical parts, and are relatively simple to machine and assemble, and have proven to be repeatable.

In summary, the present invention provides a novel, wideband, high gain antenna capable of producing dual linear and/or dual circular polarization simultaneously. Desirable symmetric E & H plane patterns over broad bandwidths, heretofore unknown in coaxial antennas, have been achieved through the physical composition of the invention.

Other technical advantages are readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which:

FIGS. 5, 6A and 6B are diagrams illustrating an antenna feed network for use in conjunction with an antenna of the present invention;

FIG. 7 is an exploded view of a coaxial cavity antenna representing an embodiment of the present invention; and FIG. 8 is a cross sectional view of a coaxial cavity antenna in accordance with the present invention.

DETAILED DESCRIPTION OF THE INVENTION

Embodiments of antennas in accordance with the present invention and advantages of the antennas are best understood by referring to FIGS. 1 through 13 of the drawings, like numerals being used for like and corresponding parts of the various Figures.

Figure 1:
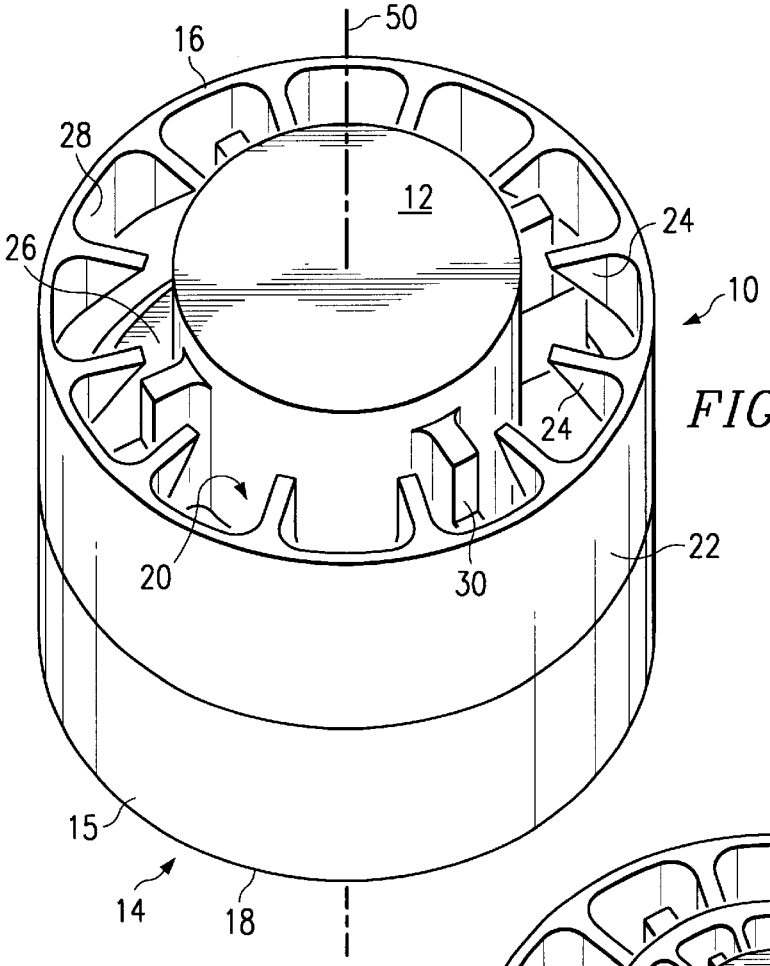
FIG. 1 is an isometric view of a coaxial cavity antenna representing an embodiment of the present invention.

FIG. 1 is an illustration of a coaxial cavity antenna 10 representing one embodiment of the present invention. Coaxial cavity antenna 10 includes a hollow, cylindrical inner conductor 12 and a cylindrical outer conductor 14 having opposite ends 16 and 18. In the illustrated embodiment, inner conductor 12 is closed at an end 16. However, inner conductor 12 can also be open at end 16, and this open space could serve as a circular waveguide antenna. In addition, although the illustrated embodiment incorporates a hollow inner conductor 12 to reduce the weight of coaxial cavity antenna 10, the inner conductor 12 could also be solid. Outer conductor 14 is disposed around and generally concentric with inner conductor 12 about axis 50. The annulus between the inner conductor 12 and the inner diameter of outer conductor 14 forms cavity 20.

Inner conductor 12, outer conductor 14, and cavity 20 are sized for effectively propagating electromagnetic waves in a range of frequencies. In the embodiment of an antenna of the present invention shown in FIG. 1, the end of inner conductor 12 extends outward along axis 50 from the end of the outer conductor 14. However, in other embodiments the end inner conductor 12 and the end outer conductor 14 are equal along the axis 50. All elements of the antenna illustrated in FIG. 1 can be scaled either larger or smaller to effectively propagate electromagnetic waves of lower or higher frequencies, respectively.

As illustrated, the outer conductor 14 includes an aperture ring 22 and a base 15. Aperture ring 22 can be formed integral with base 15 or it can be a separate part and detachable from base 15. In the illustrated embodiment, aperture ring 22 has an outer diameter equal to the outer diameter of base 15. In addition, in the embodiment wherein the aperture ring 22 is a separate part and detachable from the base 15, aperture ring 22 and base 15 are formed such that aperture ring 22 can be securely attached to base 15. An exploded view of such an embodiment is illustrated in FIG. 7.

Aperture ring 22 includes a plurality of aperture teeth 24 that are radially oriented and disposed around the inside diameter of the aperture ring. In the embodiment of the antenna of the present invention illustrated in FIG. 1, aperture teeth 24 are triangular in shape, and are equally spaced around the inside diameter of aperture ring 22 with each aperture tooth oriented generally radially towards axis 50 of the coaxial cavity antenna 10. One purpose of aperture teeth 24 is for pattern control. More specifically aperture teeth 24 function to make the E-plane and H-plane performance substantially symmetric over reasonably wide angles such as ±60 degrees.

Figure 4:
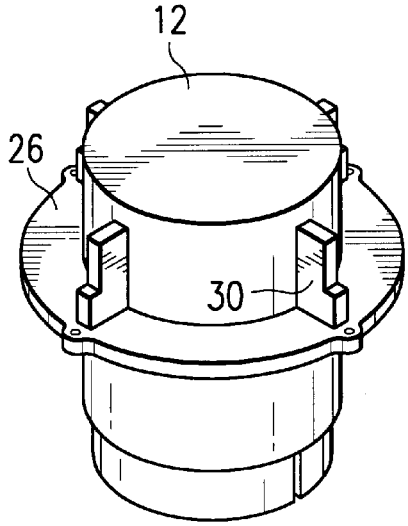
FIG. 4 is an isometric view of the inner portion of the coaxial cavity antenna of FIG. 1.

Coaxial cavity antenna 10 further includes an iris ring 26, best illustrated in FIGS. 4 and 7. Iris ring 26 has an inner diameter approximately equal to the outer diameter of inner conductor 12. However, the outer diameter of iris ring 26 is less than the inner diameter of outer conductor 14. The iris ring 26 is attached to the inner conductor 12 inside cavity 20, but does not contact an inner wall 28 of outer conductor 14.

In addition, coaxial cavity antenna 10 includes a set of four aperture blocks or septums 30. In the embodiment of the present invention shown in FIG. 4, septums 30 resemble steps. In order to more clearly illustrate the configuration and placement of septums 30, an isometric view of inner conductor 12, iris ring 26, and septums 30 is shown in FIG. 4. Septums 30 are attached to iris ring 26 and inner conductor 12. Septums 30 are positioned around inner conductor 12 at ninety degree intervals, and are attached to inner conductor 12 such that a plane passing through opposed septums includes axis 50. One function of septums 30 is for pattern control in conjunction with the aperture teeth 24. Another function of septums 30 is impedance matching.

All of the elements described above are preferably fabricated out of a conductive material. Aluminum offers a fairly lightweight and inexpensive option. However, for more weight-sensitive applications, conductive composite materials can be used.

Figure 5:
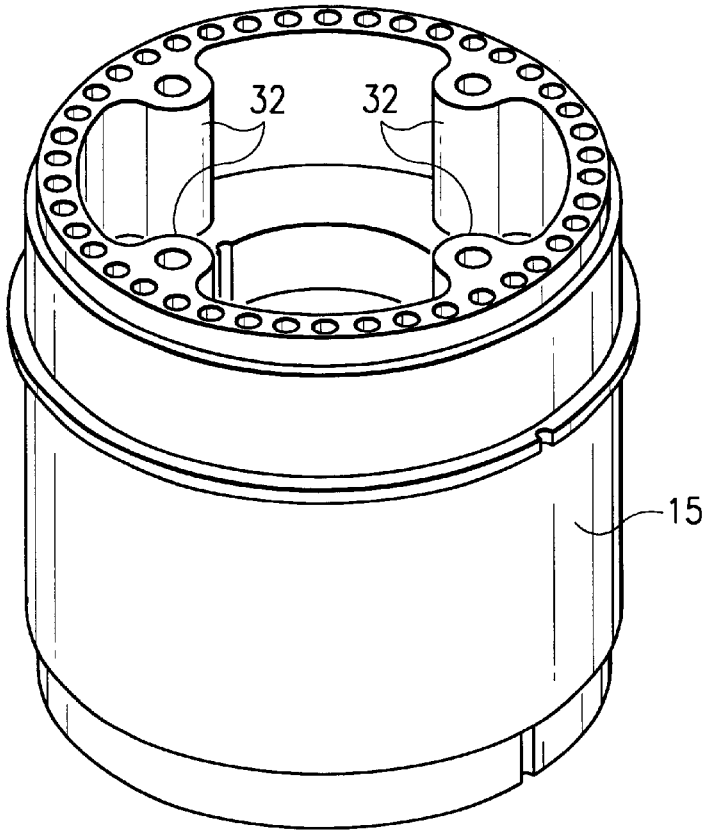
FIG. 5 is an isometric view of the outer portion of the coaxial cavity antenna of FIG. 1.

Coupled to the inner wall 28 of outer conductor 14 are a plurality of cable supports 32, shown in FIG. 5. The number of cable supports 32 equals the number of coaxial cables (not explicitly shown) that are required to receive and transmit signals In the embodiment shown in FIGS. 1 and 5, there are four cable supports 32. A conventional coaxial cable comprises an inner conductor and outer conductor that are insulated from each other. The coaxial cables are fed from end 18 of coaxial cavity antenna 10 through cable supports 32. The outer conductor of the coaxial cable is terminated to a cable support 32 and the center conductor protrudes past the cable support and into the iris ring 26, which is connected to inner conductor 12, as described above. It should be noted that iris ring 26 and cable supports 32 are not in contact, although in close proximity.

Referring to FIG. 7, there is shown an exploded view of a coaxial cavity antenna 10 embodying the present invention, and FIG. 8, where there is shown a cross sectional view of the coaxial cavity antenna embodying the present invention.

The computation to determine the diameters of inner conductor 12 and outer conductor 14 and the use of iris ring 26 in conjunction with cable supports 32, septums 30 and aperture teeth 24 is discussed below. As mentioned previously, the feed cables come up through and are grounded to cable supports 32 with the center conductors of the coaxial cables extending to the iris ring 26. The radial dimension between opposed feed cables as well as the size of cable support 32, the spacing between cable support 32 from iris ring 26, the diameter and thickness of iris ring 26, and the separation of iris ring 26 from end 18 all play a role in providing an efficient transition from the coaxial feed cables to the antenna. The transition is characterized in terms of impedance matching and/or voltage standing wave ratio (VSWR). Septums 30 and aperture teeth 24 provide additional matching support but serve mainly to equalize the E & H plane patterns. Finally, the overall depth of cavity 20 also influences the pattern performance of the antenna. The antenna as described above provides an efficient impedance match over a wide frequency range.

Figure 6A:
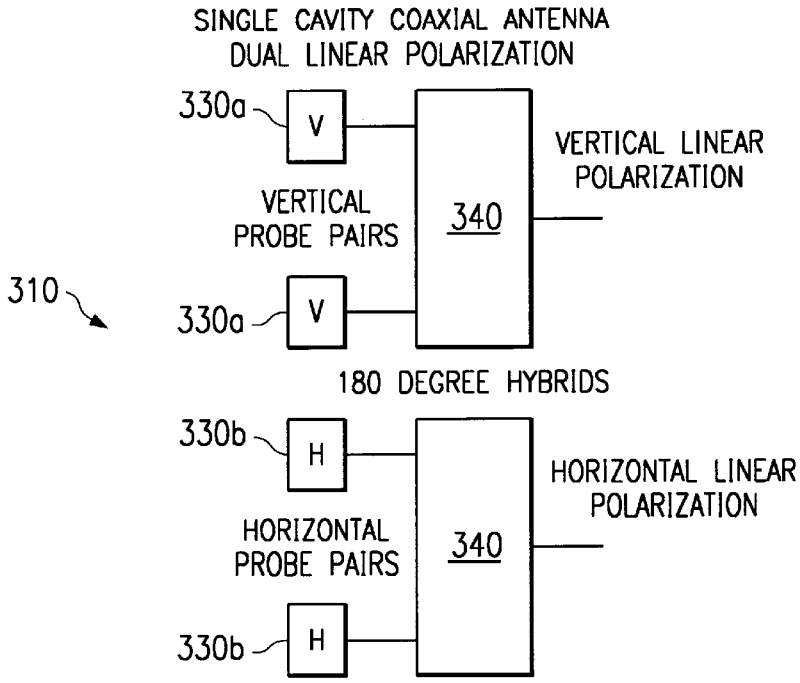
Figure 6B:
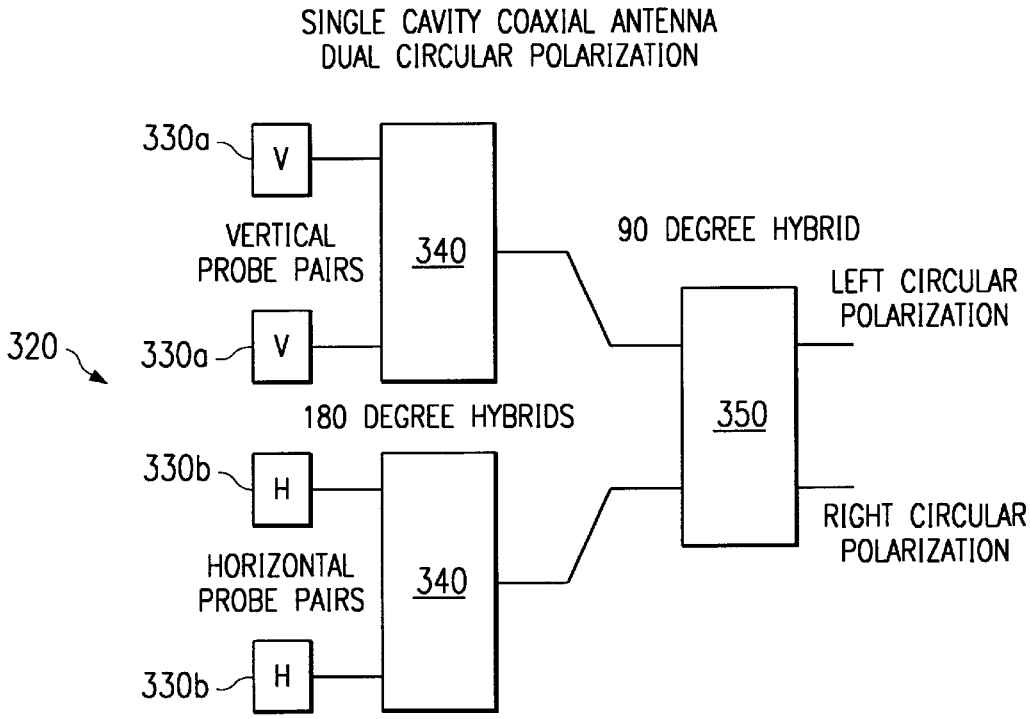

Polarization diversity is achieved through the use of a feed network. An example of feed networks 310 and 320 are illustrated in FIG. 6. The use of a feed network can produce either two orthogonal linear polarizations or both senses of circular polarization (right-handed and left-handed). As illustrated in FIG. 6, two 180 degree hybrids 340 are utilized for either case, and a 90 degree hybrid 350 is added behind hybrids for feed network 320 to get dual circular polarization. Specifically, the TE11 coaxial mode is excited by feeding signals from oppositely spaced coaxial feed terminals 330*a* and 330*b* with equal amplitude and a 180 phase shift relative to one another into 180 degree hybrids 340. The output of 180 degree hybrids 340 each provide one sense of linear polarization. The delta port is terminated. In this manner, using 180 degree hybrids 340, the signals from the four coaxial feed terminals are translated into two orthogonal linear polarizations. By definition, the two orthogonal linear polarizations are offset 90 degrees from each other. Depending on the orientation of the antenna, this can be horizontal and vertical polarization, two slant linear polarizations (oriented at ±45 degrees), or some other combination.

Subsequently, connecting these outputs through a 90 degree hybrid 350 produces both left and right circular polarization at the output ports of 90 degree hybrid 350. It should be noted that although feed networks 310 and 320 are for use with a single coaxial cavity antenna as illustrated in FIG. 1, such networks can be modified to work with a coaxial cavity antenna with multiple sub-bands, as described below in conjunction with FIGS. 2 and 3. In this case, the feed networks are simply replicated for each respective sub-band.

Figure 2:
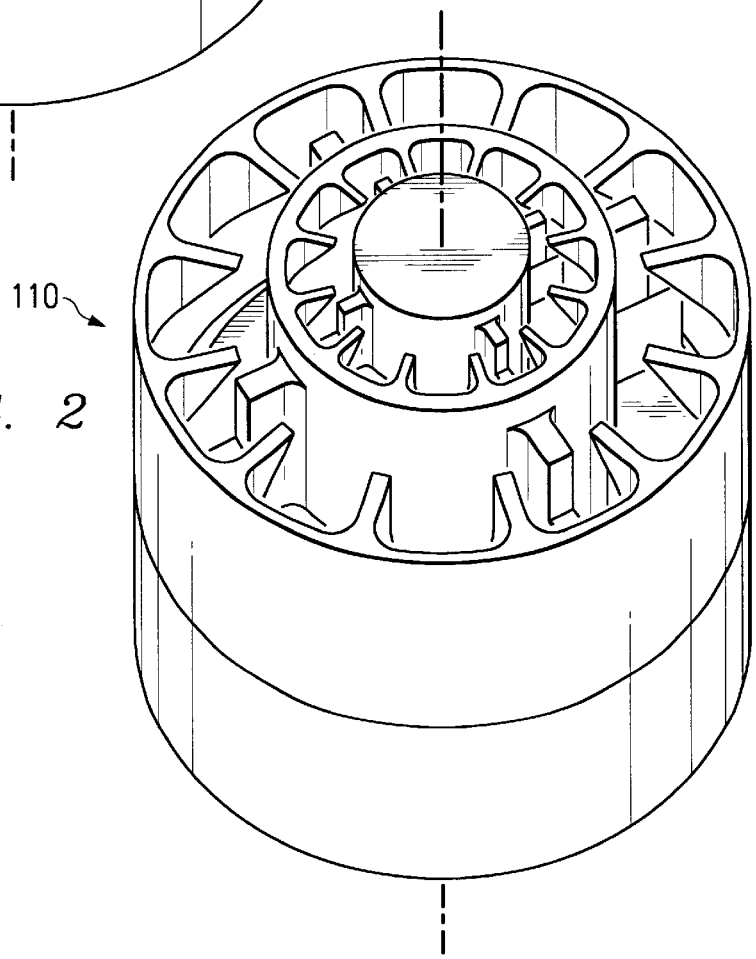
FIG. 2 is an isometric view of a multi-band coaxial cavity antenna also representing an embodiment of the present invention.
Figure 3:
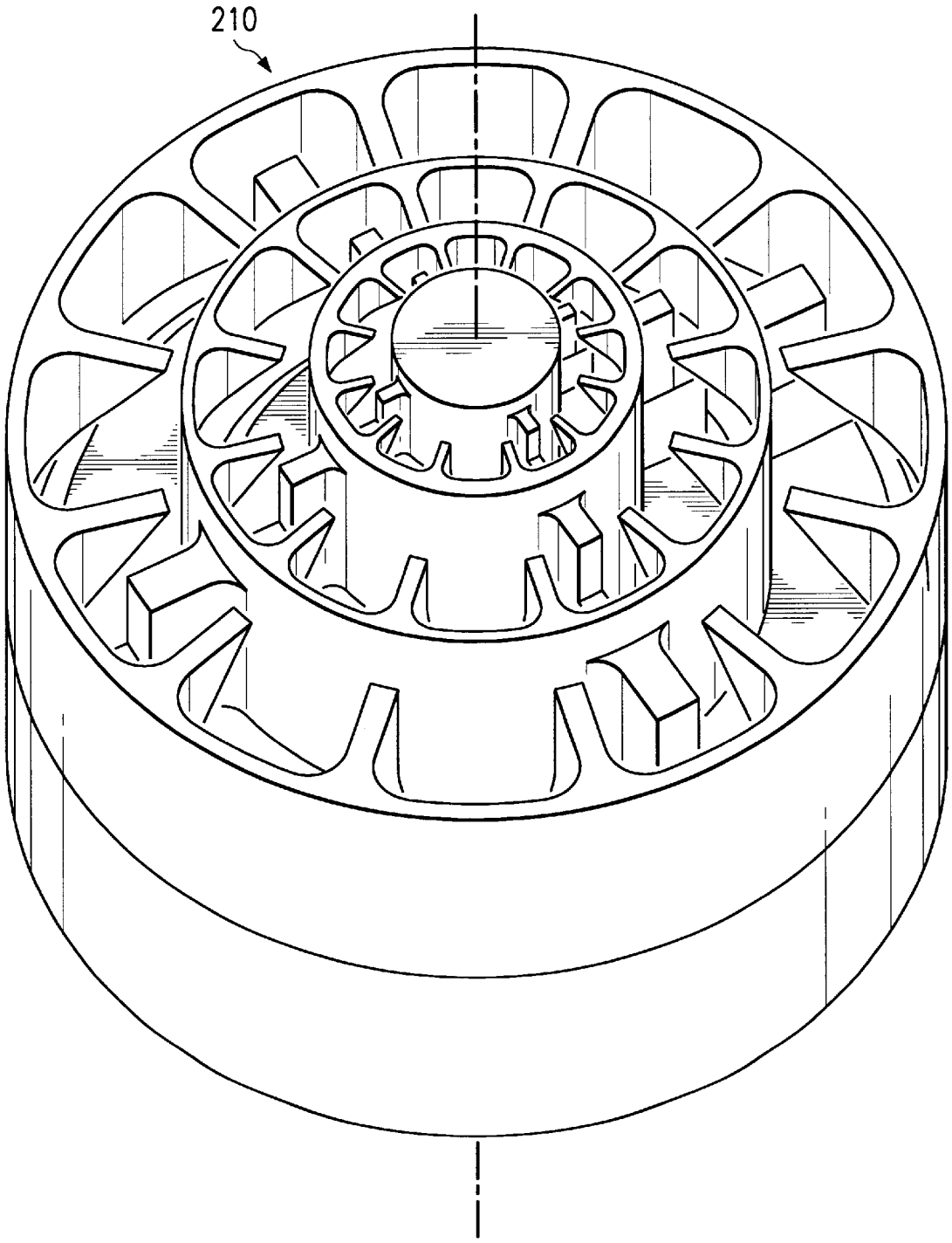
FIG. 3 is an isometric view of multi-band coaxial cavity antenna representing yet another embodiment of the present invention.

Referring to FIGS. 2 and 3, there is illustrated multi-band coaxial cavity antennas 110 and 210 representing additional embodiments of the present invention. As mentioned above, the size of coaxial cavity antenna 10, illustrated in FIG. 1, is scalable. In other words, it can be sized to operate over different frequency bands. In addition, coaxial cavity antennas representing embodiments of the present invention can be nested to provide multi-band performance. Such scaling and nesting are illustrated by coaxial cavity antennas 110 and 210. Coaxial cavity antenna 110 comprises two coaxial cavity antennas. The smaller, higher frequency antenna is nested inside the larger, lower frequency antenna. Similarly, coaxial cavity antenna 210 comprises three coaxial cavity antennas. Antennas of the present invention are not limited to those illustrated in FIGS. 1, 2 and 3. Both the number and size of the antennas can be varied to form various configurations of antennas of the present invention.

The components of each nested antenna of coaxial cavity antennas 110 and 210 are similar in form to those of coaxial cavity antenna 10, described in conjunction with FIG. 1. The various components only differ in size. Therefore, each component of the antennas of FIGS. 2 and 3 will not be described again. In order to nest a plurality of antennas, the outer conductor of the innermost antenna serves as the inner conductor for the next surrounding antenna. This is repeated for each successive antenna. In addition each nested antenna has a separate set of four coaxial cables (not explicitly shown) and four coaxial feed terminals (not explicitly shown). Such coaxial cables are connected to each nested antenna as described above in conjunction with coaxial cavity antenna 10.

Figure 9A:
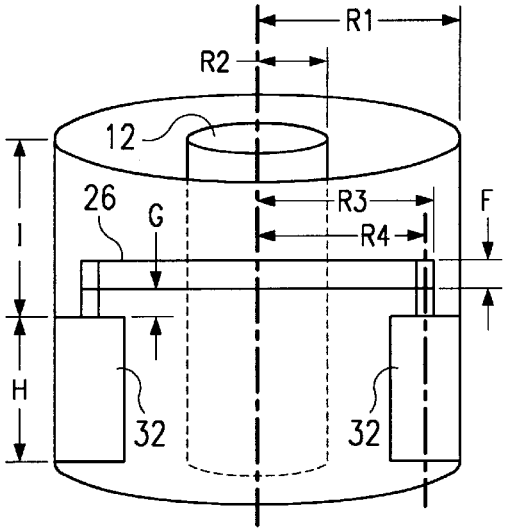
FIGS. 9A and 9B are schematic illustrations of a coaxial cavity antenna in accordance with the present invention identifying the dimension of an antenna.
Figure 9B:
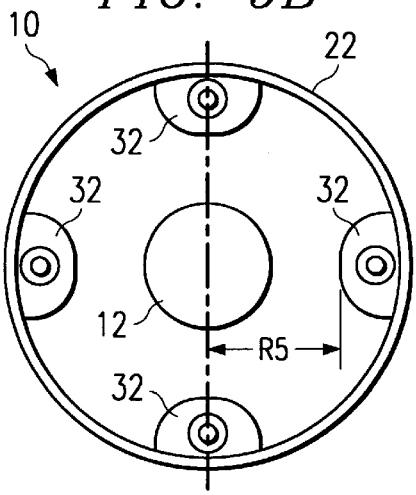

Referring to FIG. 9, there is shown an illustration identifying the dimensions for scaling an antenna to effectively propagate electromagnetic waves of lower or higher frequencies. The various parts of the antenna illustrated in FIG. 9 are identified with like numerals as used in FIG. 1 describing in detail the various parts of the antenna 10. A description of each of the dimensions illustrated in FIG. 9 are given by Table 1.

TABLE 1

| Dimensions | |
|---|---|
| R1 | Outer Cavity Inside Radius |
| R2 | Inner Cavity Outer Radius |
| R3 | Radius to Outside Edge of Feed Probe Center Conductor |
| R4 | Radius to Center of Feed Probe Center Conductor |
| R5 | Radius to Feed Probe Shelf |
| F | Feed Ring Thickness |
| G | Feed Ring to Feed Probe Gap Width |
| H | Cavity Base to Top of Feed Probe Height |
| I | Top of Feed Probe to Aperture Height |

Referring to FIG. 1 and FIG. 9 along with Table 1, dimensions for a single sub-band coaxial cavity antenna 10 is given by Table 2.

TABLE 2

| FREQ. RANGE (GHz) | 2.50–4.50 |
|---|---|
| Cavity Wall radius R1 | 1.1758 |
| Cavity Wall radius R2 | 0.6930 |
| Probe Iris radius R3 | 1.0164 |
| Rad to Coax C/L R4 | 1.0095 |
| Rad to shelf edge R5 | 0.8266 |
| Probe Iris Thickness F | 0.1156 |
| Probe Iris to Shelf gap width G | 0.0578 |
| Cavity Base to top of Shelf Height H | 0.7970 |
| Top of Shelf to Aperture Height I | 1.0834 |
| Cavity Height H + I | 1.8804 |

With reference to FIG. 1, the dimensions illustrated are for a single sub-band coaxial cavity antenna operating in a frequency range from 2.50 GHz to 4.50 GHz. The dimensions are illustrated in FIG. 9 and explained in Table 1.

Figure 10A:
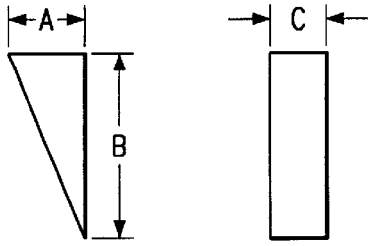
FIGS. 10A and 10B are schematic illustrations of the aperture teeth and the iris ring septums, respectively, for a coaxial cavity antenna of the previous Figures.
Figure 10B:
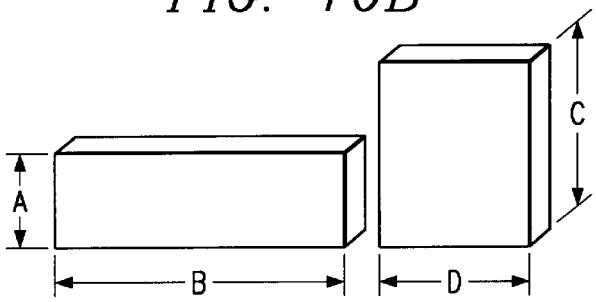

With reference to FIG. 1A, there is illustrated one of the twelve teeth 24 as shown in FIG. 1 and also illustrated for the two sub-band coaxial cavity antenna 110 of FIG. 2. FIG. 10B is an illustration of the two parts of a septum 30 as shown in FIG. 1 for the coaxial cavity antenna 10 and also illustrated in FIG. 2 for the two sub-band coaxial cavity antenna 110. With reference to Table 3, there is given the dimension for each of the teeth 24 for the single sub-band coaxial cavity antenna 10 of FIG. 1 operating in a frequency range of 2.50 GHz to 4.50 GHz. Table 4 gives the dimensions of the two parts of the septum 30 for the single sub-band antenna operating in a frequency range of 2.50 GHz to 4.50 GHz. For other frequencies, the dimensions given in Tables 2, 3 and 4 are adjusted as required.

TABLE 3

| | | |
|---|---|---|
| A | = | 0.3232 |
| B | = | 0.4620 |
| C | = | 0.0694 |

TABLE 4

| | | |
|---|---|---|
| A | = | 0.2 |
| B | = | 0.3 |
| C | = | 0.265 |
| D | = | 0.2 |
| Width | = | 0.1 |

Also given by way of example in Tables 5, 6 and 7 are the dimensions of a two sub-band coaxial cavity antenna 110, as illustrated in FIG. 2. The dimensions given in Tables 5, 6 and 7 are for a two sub-band antenna operating in a frequency range of 0.50 GHz to 2.00 GHz, with the lower sub-band operating in a frequency range of 0.50 GHz to 1.00 GHz and the upper sub-band operating in a frequency range of 1.00 GHz to 2.00 GHz. Reference is also made to FIGS. 9, 10A and 10B and Table 1 for illustrating the relationship between the dimensions of Tables 5, 6 and 7 and the two sub-band coaxial cavity antenna 110 of FIG. 2. Note that with reference to Tables 6 and 7, the first or upper set of dimensions in each of these Tables is for the lower sub-band in a frequency range of 0.50 GHz to 1.00 GHz and the lower set of dimensions in Tables 6 and 7 is for the sub-band in the range of 1.00 GHz to 2.00 GHz. Again, the dimensions are scaled for antennas operating in higher or lower frequency ranges than is given by Tables 5, 6 and 7.

TABLE 5

| FREQ. RANGE (GHz) | | 0.50–1.00 | 1.00–2.00 |
|---|---|---|---|
| Cavity Wall radius | R1 | 5.3192 | 2.6596 |
| Cavity Wall radius | R2 | 3.1350 | 1.5675 |
| Probe Iris radius | R3 | 4.5980 | 2.2990 |
| Rad to Coax C/L | R4 | 4.5668 | 2.2834 |
| Rad to shelf edge | R5 | 3.7392 | 1.8696 |
| Probe Iris Thickness | F | 0.5229 | 0.2614 |
| Probe Iris to Shelf gap width | G | 0.2614 | 0.1307 |
| Cavity Base to top of Shelf Height | H | 3.6054 | 1.8027 |
| Top of Shelf to Aperture Height | I | 3.8562 | 1.9281 |
| Cavity Height | H + I | 7.4617 | 3.7308 |

TABLE 6

| | | |
|---|---|---|
| A | = | 1.4622 |
| B | = | 2.0900 |
| C | = | 0.3139 |
| A | = | 0.7311 |
| B | = | 1.0450 |
| C | = | 0.1569 |

TABLE 7

| | | |
|---|---|---|
| A | = | 1.0000 |
| B | = | 1.5000 |
| C | = | 1.3248 |
| D | = | 1.0000 |
| Width | = | 0.5000 |
| A | = | 0.5000 |
| B | = | 0.7500 |
| C | = | 0.6624 |
| D | = | 0.5000 |
| Width | = | 0.2500 |

Figure 11:
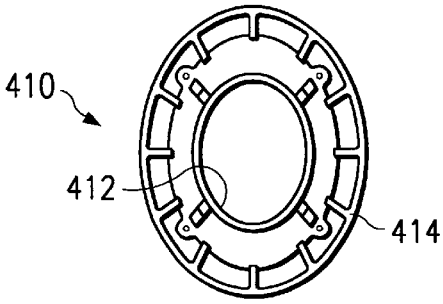
FIG. 11 is an isometric view of a coaxial cavity antenna representing an embodiment of the present invention for radiating non-circular patterns.

Referring to FIG. 11, there is shown an embodiment of the coaxial cavity antenna of the present invention providing a shaped propagated electromagnetic wave. The coaxial cavity antenna 410 of FIG. 11 includes an elliptical-shaped inner conductor 412 and a similar elliptical-shaped outer conductor 414. The shaped coaxial cavity antenna 410 of FIG. 11 includes the circumferentially distributed aperture teeth as described with reference to FIG. 1 and also the aperture blocks or septums (also shown in FIG. 1.) Also included in the shaped coaxial cavity antenna 410 are the cable supports 32 as illustrated in FIGS. 5 and 7. Thus, the variation of the antenna of FIG. 11 from the antenna of FIG. 1 is found in the elliptical-shaped inner conductor 412 and the similarly elliptically-shaped outer conductor 414.

It should also be noted with reference to FIG. 11 that multi-band coaxial cavity antennas such as illustrated in FIGS. 2 and 3 may have elliptically-shaped inner conductors and outer conductors to propagate a shaped electromagnetic wave.

Figure 12:
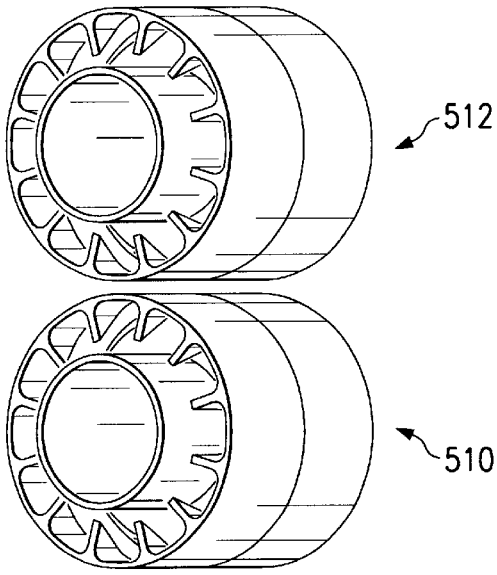
FIG. 12 is an isometric view of a vertical array of coaxial cavity antennas represented by the embodiments of FIGS. 1–3.

Referring to FIG. 12, there is shown an embodiment of the invention incorporating coaxial cavity antennas in a vertical array. As illustrated, a single sub-band coaxial cavity antenna 510 is vertically positioned with reference to a single sub-band coaxial cavity antenna 512. A vertical array of the coaxial cavity antennas of the present invention provide increased directivity (gain) by narrowing the elevation beam width. Although FIG. 12 illustrates only two single sub-band antennas as illustrated and described with reference to FIG. 1 in a vertical array, additional such antennas may be vertically arrayed to further increase directivity. In addition, the multi-band coaxial cavity antennas of FIGS. 2 and 3 may also be vertically arrayed to provide enhanced directivity to propagation of electromagnetic waves. It should be noted that the antennas 510 and 512 include the various parts described with reference to the antenna of FIG. 1.

Figure 14:
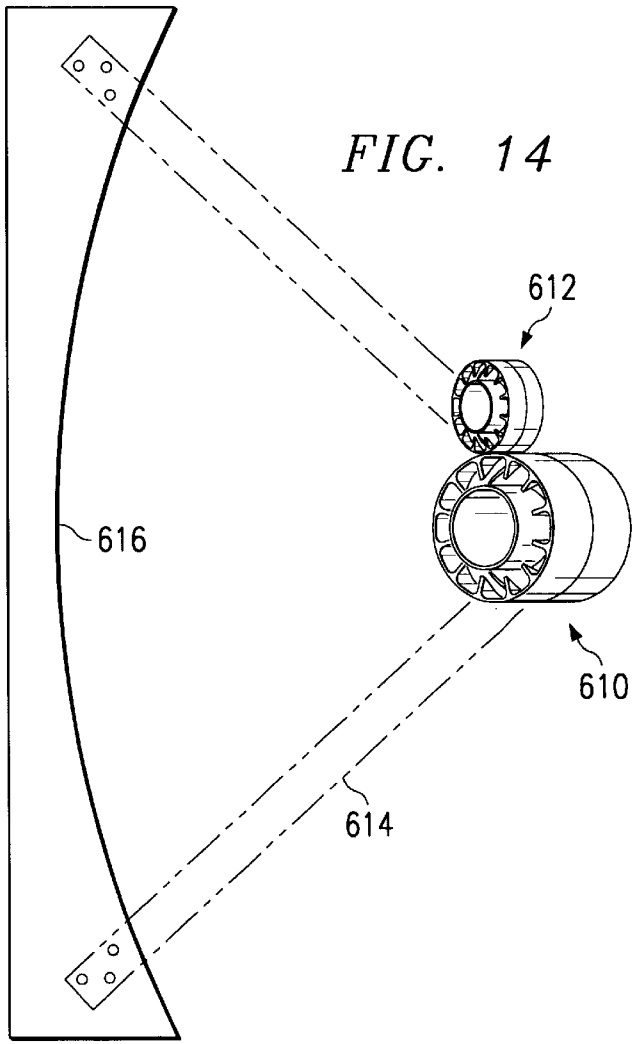
Figure 13:
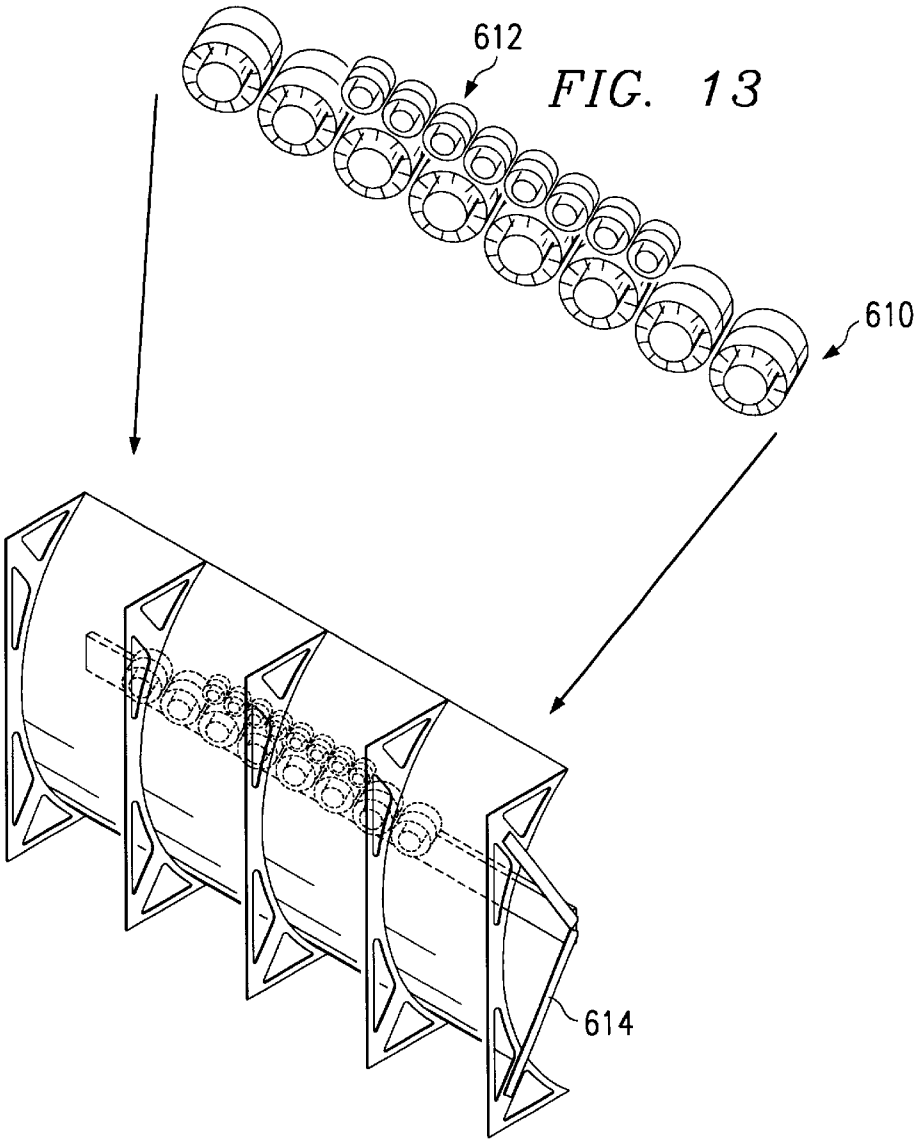
FIG. 13 is an isometric view of a line array of coaxial cavity antennas represented by the embodiments of FIGS. 1–3.

Referring now to FIGS. 13 and 14, there is illustrated a line array of coaxial cavity antennas in accordance with the present invention. Although the antennas of FIGS. 13 and 14 are illustrated as reflector feeds, this is given by way of example only and not by way of limitation. As illustrated, the line array includes a horizontal line of received coaxial cavity antennas 610 and a horizontal line of transmit coaxial cavity antennas 612. The line array of antennas 610 and 612 are mounted to a support 614 and spaced from a reflector 616.

The coaxial cavity antennas 610 and 612 comprise the single sub-band antenna 10 as illustrated and described with reference to FIG. 1. The antennas are scaled for the frequency band width of the operating system.

The various antennas of the present invention described above have numerous applications. These applications include use as a wideband, frequency scalable, high gain, and polarization diverse antenna. The coaxial antenna can be used as an element in an interferometry array for performing precision direction finding. The antenna can also be used as a radar warning receiver antenna. The unique pattern performance of the coaxial antenna enables use as a very high precision polarimetry antenna for characterizing emitter polarization. Furthermore, the circular symmetry of the antenna provides substantially equal azimuth and elevation pattern performance.

For some applications, such as platforms at long stand off ranges, it may be desirable to have wide azimuth and narrow elevation pattern performance. This can be accomplished by distorting the antenna shape into an elliptical or rectangular shape such as illustrated in FIG. 11. The elongated dimension provide narrower field of view coverage and also increase the directivity of the antenna. This can also be accomplished by stacking two coaxial antennas vertically.

The wideband coaxial antennas of the present invention can also be arrayed and implemented as a feed for reflector antennas as illustrated in FIGS. 13 and 14 in addition to use as individual antenna elements. Coaxial antennas incorporating the teachings of the present invention exhibit flat phase response over a wide frequency range and a minimum of 120 degrees, centered about zenith, in field of view. This response is in addition to a flat amplitude response. This allows the antenna to be used as a wideband and ultra-wideband antenna for the reception and transmission of extremely fast pulses. The coaxial antenna of the present invention when used as a reflector of the cassegrain, gregorian, corner, parabolic, or cylindrical type exhibits high gain across the full band of operation.

Single reflector antennas of both the cassegrain and cylindrical type have been built. The gain of the cassegrain, over the band of operation is at least 30 dB minimum. The reflector uses a coaxial antenna configured for a single polarization or for all polarizations via the incorporated feed network. With the incorporated feed network, the resultant reflector antenna receives or transmits in all polarizations, including the four basic polarizations of horizontal, vertical, right hand circular and left hand circular.

The antennas of the present invention are also useful as a feed for any type of reflector. However, for cylindrical applications, the antennas are placed in a line feed array and scanned electronically in the non-varying plane of the reflector. Offset line arrays are placed next to the primary banded line array resulting in the reflector antenna useful over multiple bands of operation in the same aperture area.

Although the present invention and its advantages have been described in detail, it should be understood that various changes, substitutions, and alterations can be made therein without departing from the spirit and scope of the present invention as defined by the appended claims.

What is claimed is:

1. A coaxial cavity antenna, comprising:

an inner conductor sized for propagation of electromagnetic signals in a preselected frequency range;

a plurality of outer conductors positioned generally coaxial with the inner conductor, each successive outer conductor having a diameter larger than the adjacent outer conductor, one of the plurality of outer conductors positioned with respect to the inner conductor to form a cavity between the inner conductor and the adjacent outer conductor, each successive pair of outer conductors positioned to form a cavity, each cavity sized for propagating electromagnetic signals in the preselected frequency range; and a plurality of iris rings, each iris ring positioned inside a cavity and sized to contact the outer surface of a conductor forming a cavity with an adjacent conductor and further sized to not contact the inner surface of the adjacent conductor.

2. A coaxial cavity antenna system, comprising:

a coaxial cavity antenna comprising:

a cylindrical inner conductor sized for propagation of electromagnetic signals in a preselected frequency range;

a cylindrical outer conductor positioned coaxial with the inner conductor, and having a diameter larger than the inner conductor, the outer conductor having an aperture ring as a part thereof, the outer conductor positioned with respect to the inner conductor to form a cavity between the inner conductor and the outer conductor, the cavity sized for propagating electromagnetic signals in the preselected frequency range;

a plurality of aperture teeth radially oriented and disposed around the aperture ring;

an iris ring positioned inside the cavity;

a plurality of septums coupled to the inner conductor and the iris ring;

a plurality of cable supports attached to the outer conductor;

an antenna feed network, comprising:

a first 180° hybrid receiving vertical probe inputs and providing a vertical probe output;

a second 180° hybrid receiving horizontal probe input and providing a horizontal probe output; and a 90° hybrid receiving the vertical probe output of the first 180° hybrid and the horizontal probe output from the second 180° hybrid, said 90° hybrid generating a left circular polarization signal connected to selected ones of the plurality of cable supports and generating a right circular polarization signal applied to selected other of said plurality of cable supports.

3. A coaxial cavity antenna system, comprising:

a coaxial cavity antenna comprising:

a cylindrical inner conductor sized for propagation of electromagnetic signals in a preselected frequency range;

a cylindrical outer conductor positioned coaxial with the inner conductor, and having a diameter larger than the inner conductor, the outer conductor having an aperture ring as a part thereof, the outer conductor positioned with respect to the inner conductor to form a cavity between the inner conductor and the outer conductor, the cavity sized for propagating electromagnetic signals in the preselected frequency range;

a plurality of aperture teeth radially oriented and disposed around the aperture ring;

an iris ring positioned inside the cavity;

a plurality of septums coupled to the inner conductor and the iris ring;

a plurality of cable supports attached to the outer conductor;

an antenna feed network, comprising:

a first 180° hybrid receiving vertical probe pair inputs and generating a vertical linear polarization signal applied to a selected plurality of said cable supports; and a second 180° hybrid receiving horizontal probe pair inputs and generating a horizontal linear polarization signal applied to selected others of the plurality of cable supports.

4. A coaxial cavity antenna, comprising:

an inner conductor having an elliptical configuration and sized for propagation of electromagnetic signals in a preselected frequency range;

a plurality of outer conductors positioned generally coaxial with the inner conductor, each successive outer conductor having an elliptical configuration and a diameter larger than the adjacent outer conductor, one of the plurality of outer conductors positioned with respect to the inner conductor to form a cavity between the inner conductor and the adjacent outer conductor, each successive pair of outer conductors positioned to form a cavity, each cavity sized for propagating electromagnetic signals in the preselected frequency range;

a plurality of iris rings, each iris ring positioned inside a cavity and sized to contact the outer surface of a conductor forming a cavity with an adjacent conductor and further sized to not contact the inner surface of the adjacent conductor; and a plurality of septums coupled to each iris ring.

5. A coaxial cavity antenna, comprising:

an inner conductor sized for propagation of electromagnetic signals in a preselected frequency range;

an outer conductor positioned coaxial with the inner conductor, and having a diameter larger than the inner conductor, the outer conductor having an aperture ring as a part thereof at an end of the outer conductor, the outer conductor positioned with respect to the inner conductor to form a cavity between the inner conductor and the outer conductor, the cavity sized for propagating electromagnetic signals in the preselected frequency range;

a plurality of aperture teeth radially oriented and disposed around the aperture ring;

an iris ring positioned inside the cavity; and a plurality of septums coupled to the inner conductor and the iris ring.

6. The coaxial cavity antenna of claim 5, wherein the inner conductor and each of the at least one outer conductors comprises an elliptical configuration having a major and minor access selected to provide a selected narrow field of view coverage.

7. A vertical stacked coaxial cavity antenna array, comprising:

a first coaxial cavity antenna having a longitudinal axis and size for propagation of electromagnetic signals in a preselected frequency range;

at least one additional coaxial cavity antenna each sized for propagation of electromagnetic signals in the preselected frequency range, each of said at least one additional coaxial cavity antenna having a longitudinal axis aligned with the longitudinal axis of said first coaxial cavity antenna;

wherein each coaxial cavity antenna of the vertical array comprises:

an inner conductor sized for propagation of electromagnetic signals in a preselected frequency range;

an outer conductor positioned coaxial with the inner conductor, and having a diameter larger than the inner conductor, the outer conductor having an aperture ring as a part thereof at an end of the outer conductor, the outer conductor positioned with respect to the inner conductor to form a cavity between the inner conductor and the outer conductor, the cavity sized for propagating electromagnetic signals in the preselected frequency range;

a plurality of aperture teeth radially oriented and disposed around the aperture ring;

an iris ring positioned inside the cavity; and a plurality of septums coupled to the inner conductor and the iris ring.

8. The coaxial cavity antenna of claim 7, wherein the inner conductor and each of the at least one outer conductors comprises an elliptical configuration having a major and minor access selected to provide a selected narrow field of view coverage.

9. The vertical stacked coaxial cavity antenna array of claim 7, wherein the inner conductor and the outer conductor comprise a closed end cylinder.

10. A linear coaxial cavity antenna array, comprising:

a first coaxial cavity antenna having a longitudinal axis and size for propagation of electromagnetic signal in a preselected frequency range;

at least one additional coaxial cavity antenna sized for propagation of electromagnetic signals in the preselected frequency range, each of said at least one coaxial cavity antenna having a longitudinal axis in parallel alignment with an adjacent coaxial cavity antenna;

wherein the first coaxial cavity antenna and each of the at least one additional coaxial cavity antenna comprises:

an inner conductor sized for propagation of electromagnetic signals in a preselected frequency range;

an outer conductor positioned coaxial with the inner conductor, and having a diameter larger than the inner conductor, the outer conductor having an aperture ring as a part thereof at an end of the outer conductor, the outer conductor positioned with respect to the inner conductor to form a cavity between the inner conductor and the outer conductor, the cavity sized for propagating electromagnetic signals in the preselected frequency range;

a plurality of aperture teeth radially oriented and disposed around the aperture ring;

an iris ring positioned inside the cavity; and a plurality of septums coupled to the inner conductor and the iris ring.

11. The coaxial cavity antenna of claim 10, wherein the inner conductor and each of the at least one outer conductors comprises an elliptical configuration having a major and minor access selected to provide a selected narrow field of view coverage.

12. The vertical stacked coaxial cavity antenna array of claim 10, wherein the inner conductor and the outer conductor comprise a closed end cylinder.

13. A coaxial cavity antenna, comprising:

a cylindrical inner conductor sized for propagation of electromagnetic signals in a preselected frequency range;

a cylindrical outer conductor positioned coaxial with the inner conductor, and having a diameter larger than the inner conductor, the outer conductor having an aperture ring as a part thereof, the outer conductor positioned with respect to the inner conductor to form a cavity between the inner conductor and the outer conductor, the cavity sized for propagating electromagnetic signals in the preselected frequency range;

a plurality of aperture teeth radially oriented and disposed around the aperture ring;

an iris ring positioned inside the cavity; and a plurality of septums coupled to the inner conductor and the iris ring.

14. The coaxial cavity antenna of claim 13, wherein each of the plurality of septums comprises a substantially stair-step outline configured for impedance matching.

15. The coaxial cavity antenna of claim 13, wherein the plurality of septums comprise an outline configuration selected for impedance matching.

16. The coaxial cavity antenna of claim 13, wherein each aperture ring includes from 8 to 12 aperture teeth equally spaced around the aperture ring.

17. A coaxial cavity antenna, comprising:

an inner conductor sized for propagation of electromagnetic signals in a preselected frequency range;

at least one outer conductor positioned coaxial with the inner conductor, each successive outer conductor having a diameter larger than the adjacent outer conductor and having an aperture ring as a part thereof, one of the at least one outer conductors positioned with respect to the inner conductor to form a cavity between the inner conductor and the adjacent outer conductor, each successive pair of outer conductors positioned to form a cavity, each cavity sized for propagating electromagnetic signals in a preselected frequency range;

a plurality of aperture teeth radially oriented and disposed around each aperture ring;

an iris ring positioned inside each cavity; and a plurality of septums coupled to each iris ring.

18. The coaxial cavity antenna of claim 17, wherein each cavity includes four septums spaced equidistant around the iris ring.

19. The coaxial cavity antenna of claim 17, wherein the aperture ring for each of the at least one outer conductors comprises a part detachable from the at least one outer conductor.

20. The coaxial cavity antenna of claim 17, wherein the inner conductor comprises a closed end configuration.

21. The coaxial cavity antenna of claim 17 further comprising a plurality of cable supports coupled to each of the outer conductors.

22. A coaxial cavity antenna, comprising:

a cylindrical inner conductor for propagation of electromagnetic signals in a preselected frequency range;

at least one cylindrical outer conductor positioned coaxial with the inner conductor, each successive outer conductor having a diameter larger than an adjacent outer conductor, and having an aperture ring as a part of thereof, one of the at least one outer conductors positioned with respect to the inner conductor to form a cavity between the inner conductor and the adjacent outer conductor, each successive pair of outer conductors positioned to form a cavity, each cavity sized for propagating electromagnetic signals in a preselected frequency range;

a plurality of aperture teeth radially oriented and disposed around each aperture ring;

an iris ring positioned inside each cavity and;

a plurality of septums coupled to each iris ring.

23. The coaxial cavity antenna of claim 22, wherein each cavity includes four septums spaced equidistant around the iris ring.

24. The coaxial cavity antenna of claim 22, wherein the aperture ring for each of the at least one outer conductors comprises a part detachable from the at least one outer conductor.

25. The coaxial cavity antenna of claim 22, wherein the inner conductor comprises a closed end cylinder.

26. The coaxial cavity antenna of claim 22 further comprising a plurality of cable supports attached to each outer conductor.

27. The coaxial cavity antenna of claim 22 wherein the interconductor, each of the at least one outer conductors, the plurality of aperture teeth, the iris ring positioned inside each cavity and the plurality of septums coupled to each iris ring comprise an aluminum material.

28. The coaxial cavity antenna of claim 22 wherein the interconductor, each of the at least one outer conductors, the plurality of aperture teeth, the iris ring positioned inside each cavity and the plurality of septums coupled to each iris ring include a structural plastic coated with a metal.

29. The coaxial cavity antenna of claim 22, wherein the preselected frequency range comprises a bandwidth of 0.50 to 2.0 GHz.

30. The coaxial cavity antenna of claim 22, wherein the preselected frequency range comprises a bandwidth of 2.0 to 8.0 GHz.

31. The coaxial cavity antenna of claim 22, wherein the preselected frequency range comprises a bandwidth of 2.0 to 18.0 GHz.

* * * * *

UNITED STATES PATENT AND TRADEMARK OFFICE

CERTIFICATE OF CORRECTION

PATENT NO. : 6,356,241 B1
DATED : March 12, 2002
INVENTOR(S) : Rodney H. Jaeger et al.

It is certified that error appears in the above-identified patent and that said Letters Patent is hereby corrected as shown below:

Column 1,
Line 6, the phrase "Coaxial Cavity Antenna" should be italicized.

Column 2,
Line 58, after "FIGS." and before "6A," delete "5,".

Column 4,
Line 34, after "signals", insert -- . --.

Column 6,
Line 46, after "FIG." delete "1A" and insert -- 10A --.

Column 8,
Line 3, after "FIG.1" delete ".)" and insert -- ). --.

Signed and Sealed this

Twenty-fourth Day of September, 2002

*Attest:*

*Attesting Officer*

JAMES E. ROGAN
*Director of the United States Patent and Trademark Office*